US010118678B2

(12) United States Patent
Dias

(10) Patent No.: US 10,118,678 B2
(45) Date of Patent: Nov. 6, 2018

(54) COLLAPSIBLE AND PORTABLE RACK FOR STORING BOARDSPORT EQUIPMENT

(71) Applicant: Rodolpho B. Dias, San Diego, CA (US)

(72) Inventor: Rodolpho B. Dias, San Diego, CA (US)

( * ) Notice: Subject to any disclaimer, the term of this patent is extended or adjusted under 35 U.S.C. 154(b) by 0 days.

(21) Appl. No.: 14/569,643

(22) Filed: Dec. 13, 2014

(65) Prior Publication Data

US 2016/0167748 A1 Jun. 16, 2016

(51) Int. Cl.
*B63B 35/79* (2006.01)

(52) U.S. Cl.
CPC ..... *B63B 35/7946* (2013.01)

(58) Field of Classification Search
CPC ..... B63B 35/7946; A47B 81/00; A47B 43/00; A47B 61/02; A63B 71/0045; A63B 71/0035; A63B 71/00; A63B 2210/50; A63B 2069/068; A63B 60/56; F16M 11/38; A47G 25/0664; A47G 25/0685; A47F 5/10; A47F 57/04; A63C 11/007; A63C 11/028; A45C 9/00
USPC ..... 211/85.7, 149, 186, 187, 189, 190, 195, 211/207, 85.3, 85.2, 4, 6, 7, 57.1, 59.1, 211/54.1, 70.5, 175, 1.3, 193, 204, 206; 312/245, 244, 205, 313, 258, 262; 206/287.1, 284, 285, 286, 289, 290, 298; 190/1, 102, 13 R, 14, 15 R, 15.1
See application file for complete search history.

(56) References Cited

U.S. PATENT DOCUMENTS

| | | | | | |
|---|---|---|---|---|---|
| 1,724,218 | A * | 8/1929 | Nixon | A47B 61/02 | 211/1.3 |
| 2,061,499 | A * | 11/1936 | Bode | D06F 57/12 | 211/1.3 |
| 2,784,004 | A * | 3/1957 | Hamrick, Jr. | B62B 1/12 | 108/48 |
| 4,193,495 | A * | 3/1980 | Keeley | 294/143 | |
| 4,779,914 | A * | 10/1988 | Friedline | 294/143 | |
| 5,465,883 | A * | 11/1995 | Woodward | 224/495 | |
| 5,477,968 | A * | 12/1995 | Largent et al. | 211/60.1 | |
| 6,073,783 | A * | 6/2000 | Allman | F26B 25/18 | 211/85.3 |
| 6,164,465 | A * | 12/2000 | Schroeder | A47B 43/00 | 211/149 |
| 6,390,309 | B1 * | 5/2002 | Tucker | 211/85.7 | |
| 6,457,619 | B1 * | 10/2002 | Werner | B60P 3/40 | 211/70.1 |
| 7,784,624 | B1 * | 8/2010 | Pinto | 211/85.7 | |
| 2003/0178382 | A1 * | 9/2003 | Tucker | 211/85.7 | |
| 2007/0256995 | A1 * | 11/2007 | Tenreiro et al. | 211/85.7 | |

(Continued)

*Primary Examiner* — Theodore V Adamos
(74) *Attorney, Agent, or Firm* — David B. Waller

(57) ABSTRACT

The present invention is a collapsible rack and methods of using the collapsible rack for storing boardsport equipment. The collapsible rack has an upper portion and a lower portion connected by at least one lockable hinge. The upper portion has a rotatable top bar having three or more rails extending parallel to each other and a locking arm to maintain the rails perpendicular to the upper portion when in use. The lower portion has a rotatable platform base and a locking arm to maintain the base perpendicular to the lower portion when in use. The lower or upper portion may also have a handle about the middle of one of its sides and a closure mechanism to maintain the rack in collapsed configuration for easy transport.

9 Claims, 5 Drawing Sheets

(56) References Cited

U.S. PATENT DOCUMENTS

| | | | | |
|---|---|---|---|---|
| 2011/0146098 | A1* | 6/2011 | Vezina et al. | 34/60 |
| 2011/0174754 | A1* | 7/2011 | Entz | 211/202 |
| 2012/0125728 | A1* | 5/2012 | Tamarkin | A45C 5/04 190/13 R |
| 2012/0168480 | A1* | 7/2012 | Gray | 224/519 |
| 2014/0032447 | A1* | 1/2014 | Fisher | A47F 7/0021 705/500 |
| 2014/0129485 | A1* | 5/2014 | Fisher | 705/500 |

* cited by examiner

COLLAPSIBLE AND PORTABLE RACK FOR STORING BOARDSPORT EQUIPMENT

CROSS-REFERENCE TO RELATED APPLICATIONS

This patent application claims priority to U.S. Provisional Patent Application No. 61/920,707, entitled "Collapsible and Portable Rack for Storing Boardsport Equipment," filed Dec. 24, 2013, which is hereby incorporated by reference in its entirety for all purposes.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

TECHNICAL FIELD

The present invention relates to devices for storing boardsport equipment that reduces damage from contacting other equipment. More specifically, devices that allow the user to store boardsport equipment such as surfboards, paddle boards, snowboards, kite boards, skiboards, skyboards, wake boards, skim boards and skateboards, separated and in an upright position on site and prior to use.

BACKGROUND OF THE INVENTION

A number of devices have been developed for transporting boardsport equipment such as cases and vehicle racks. These devices are often limited on the number of boards that can be easily and safely carried at a single time and usually stack the equipment one on top of the other which can cause damage. To resolve this problem, carrying cases have been designed that can carry two boards separated by a layer of fabric preventing direct contact between the boards thereby reducing the potential for damage, see U.S. Pat. No. 5,094,344. These types of cases can be used in conjunction with vehicle racks to reduce potential damage during long distance transport.

Other devices are designed for mounting on walls to store boardsport equipment in closets and garages. However, with single mounting brackets like those described in U.S. Pat. No. 5,145,135, the user must mount two brackets for each board. This process, along with aligning the brackets can make this device difficult to set-up. Other devices solve this problem by providing multiple hangers in a single unit. While these systems are well suited for seasonal storage of boards they are stationary and are not easily transported.

Another device has been developed that solves the problem of transporting multiple boards simultaneously. The device is an A-frame structure having multiple horizontal hangers for boards on one or both sides of the frame with casters that allow the frame to be easily manipulated on flat hard surfaces, see t-rax.com on the worldwide web. However, these A-frame racks are large, heavy and cannot be easily transported or used on soft surfaces such as sand.

Single board free-standing racks are another type of storage device that maintain the boards in a vertical orientation almost anywhere in the home, see Outlaw Surfin rack from surfshop.com. However, these racks can only support a single board and are designed for flat solid surfaces. Other free-standing racks provide multiple slots for maintaining boards in a vertical orientation for closets and garages, see epicsurfracks.com on the worldwide web. These racks are made of sturdy heavy weight materials, generally used for seasonal storage and not easily transportable.

None of the devices described above can be easily and safely used on site, such as a beach, to store multiple pieces of equipment prior to use in an upright orientation that helps to prevent damage from laying or stacking the equipment on the sand. While many racks are known that may be used for seasonal storage of equipment, these racks are usually large, cumbersome and not easily transported.

Consequently, there is a need in the boardsport industry for a device that is easily transported and set up on site to maintain boardsport equipment in an upright position before and during use.

SUMMARY OF THE INVENTION

The present invention provides a collapsible rack for storing boardsport equipment comprising an upper portion and a lower portion connected by at least one lockable hinge. The upper portion having a rotatable top bar with three or more rails extending parallel to each other from the top bar wherein the rails on either end having a locking arm to maintain the rails perpendicular to the upper portion when in use. The lower portion having a rotatable platform base wherein the ends of the rotatable platform base having a locking arm to maintain the base perpendicular to the lower portion when in use. The lower portion or the upper portion may further comprise a handle about the middle of one of its sides and/or a locking mechanism to maintain the rack in a collapsed configuration. The collapsible rack may be made of a variety of materials including wood, metal, polymer, wood and metal, metal and polymer, polymer and wood or wood, polymer and metal.

In another aspect of the present invention the upper portion having an extendable rack and a rotatable top bar with three or more rails extending parallel to each other from the top bar wherein the rails on either end having a locking arm to maintain the rails perpendicular to the upper portion when in use.

In one embodiment, the collapsible rack may have rails encased with and/or the top bar comprising a flexible material to protect the boardsport devices from damage. The rails may be affixed stationarily or rotatably to the top bar. In the rotatable configuration each rail may be independently rotated and locked into place as needed during use. The rails may further comprise one or more restraining straps affixed by one end to the rail and having a connector on the other to be received by an attachment adapter on an adjacent rail.

In another embodiment, the platform base further comprises one or more stabilizers rotatably or slidably affixed on either side of the platform base. In other embodiments, the rack may further comprises one or more hooks for hanging a wetsuit or other gear such as fins, one or more adapters on the side for connecting two or more racks together during use, means for securing each or all of the boards stored in the rack separately or simultaneously and a shoulder strap or harness for easy transport.

In another aspect, a method is provided for storing boardsport equipment before use utilizing the collapsible rack of the present invention. The method comprises setting up a collapsible rack having an upper portion and a lower portion connected by at least one lockable hinge and placing the boardsport equipment in the rack prior to use. The upper portion of the collapsible rack having a rotatable top bar with three or more rails extending parallel to each other from the top bar wherein the rails on either end having a locking arm to maintain the rails perpendicular to said upper portion when in use. The lower portion having a rotatable platform base wherein the ends of the rotatable platform base having a locking arm to maintain the base perpendicular to the lower portion when in use.

DETAILED DESCRIPTION

Figure 1:
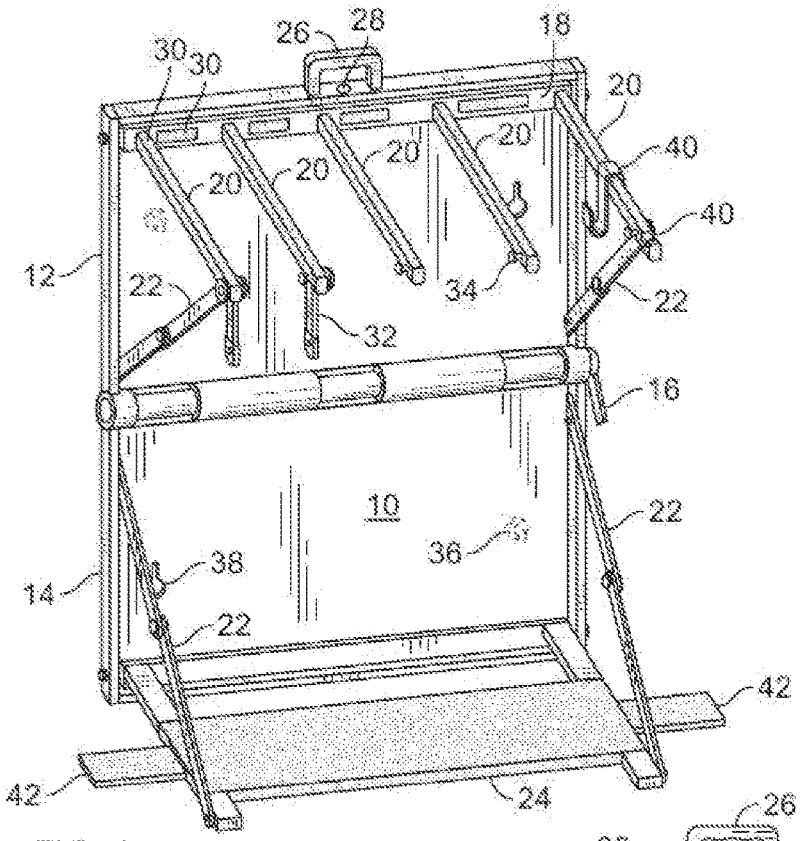
FIG. 1: is a perspective view of one embodiment of the present invention.
Figure 2:
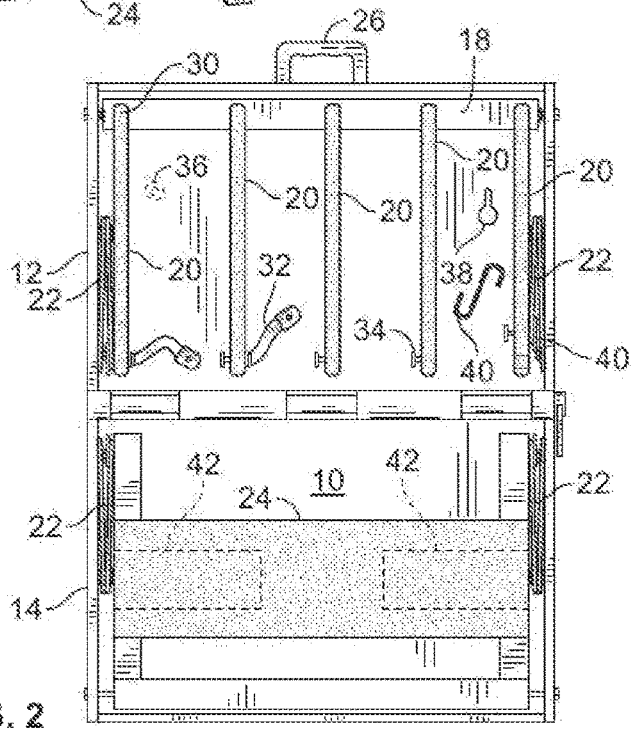
FIG. 2: is a diagrammatic representation of the collapsible rack in FIG. 1 showing the front view with the rotatable top bar and platform base collapsed within the upper and lower portions of the device respectively.
Figure 3:
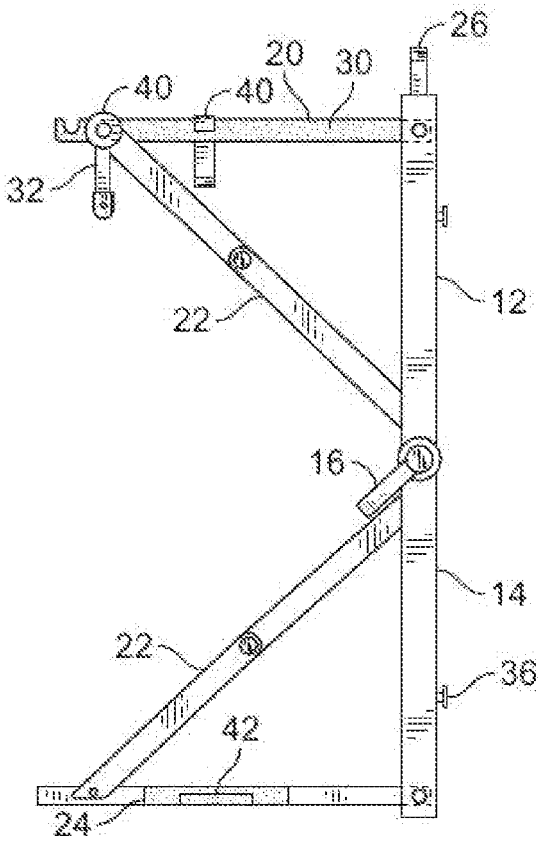
FIG. 3: is a diagrammatic representation of the side view with the device in the fully open position.
Figure 4:
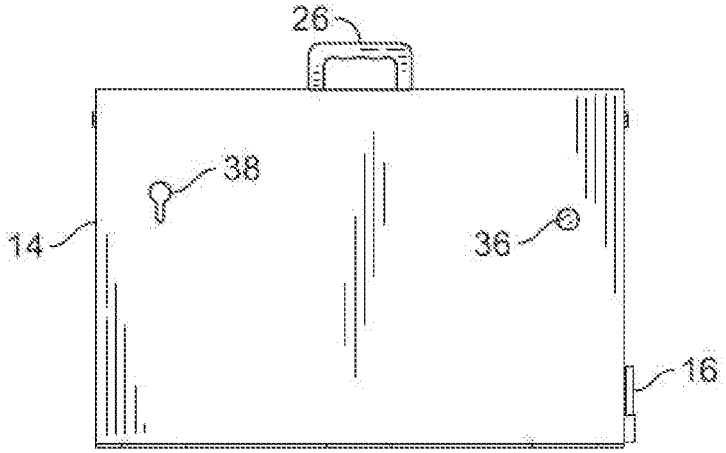
FIG. 4: is a diagrammatic representation of the fully closed device.
Figure 5:
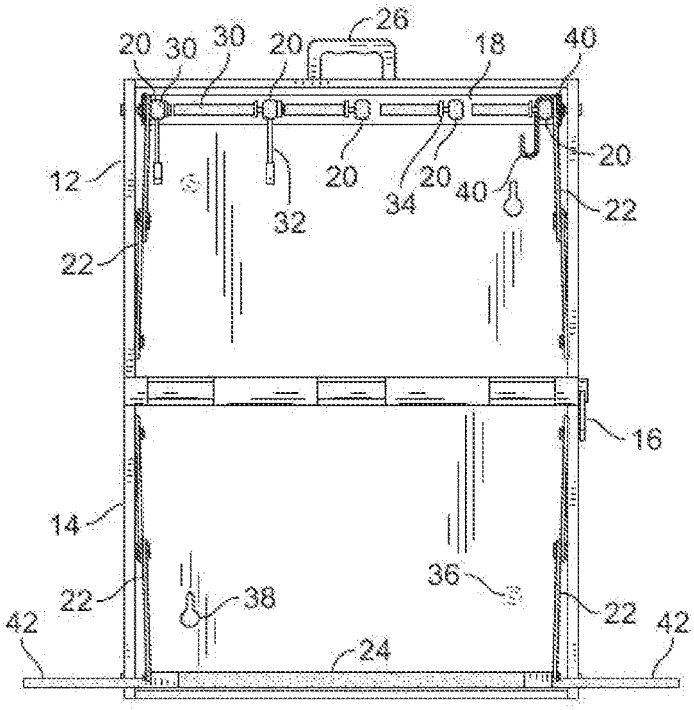
FIG. 5: is a diagrammatic representation of the front view of the device in the fully open position.
Figure 6:
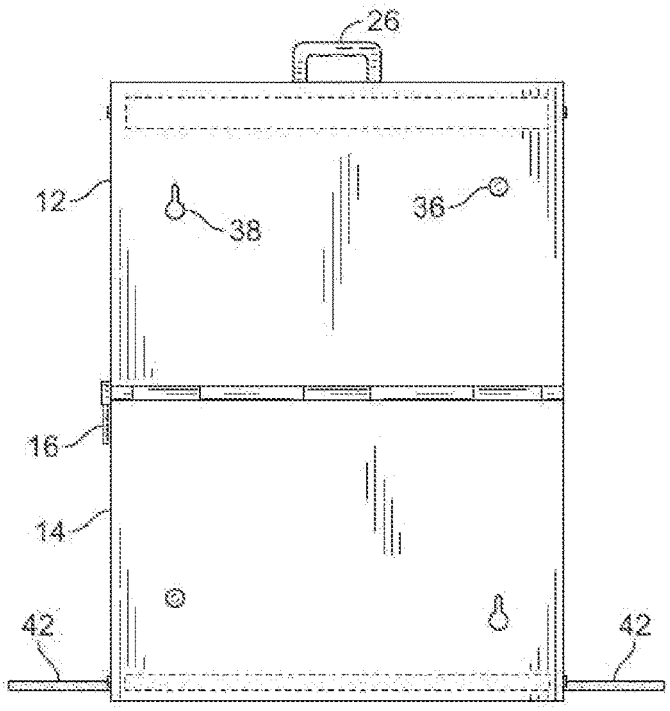
FIG. 6: is a diagrammatic representation of the back view of the device in the fully open position.
Figure 7:
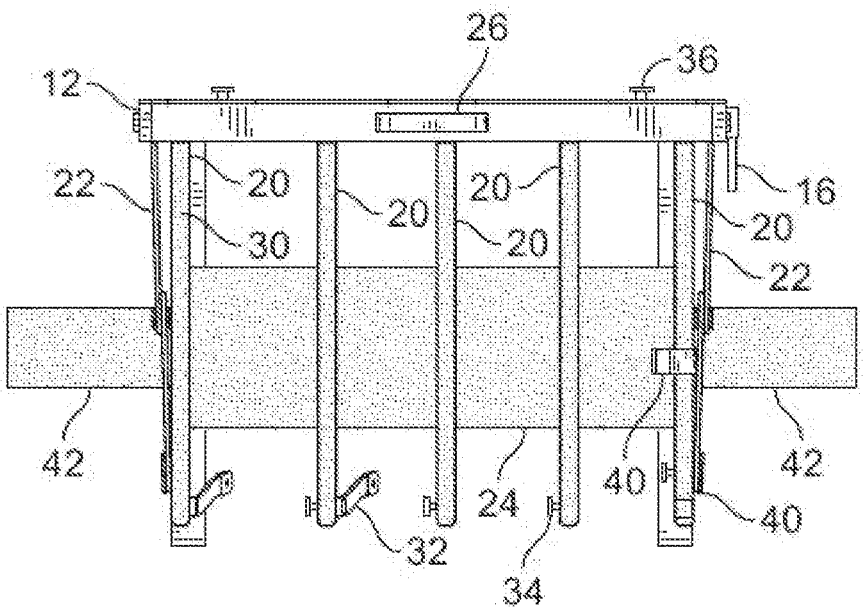
FIG. 7: is a diagrammatic representation of the top view of the device in the fully open position.
Figure 8:
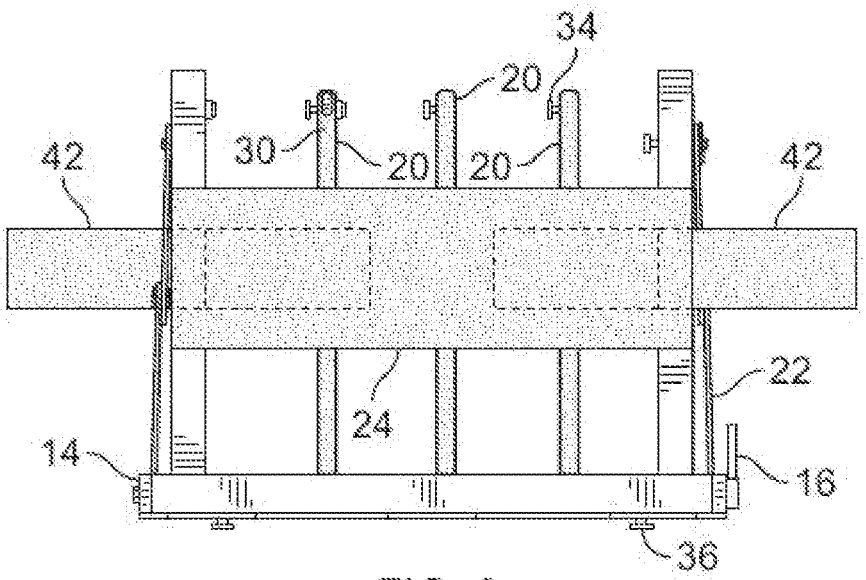
FIG. 8: is a diagrammatic representation of the bottom view of the device in the fully open position.
Figure 9:
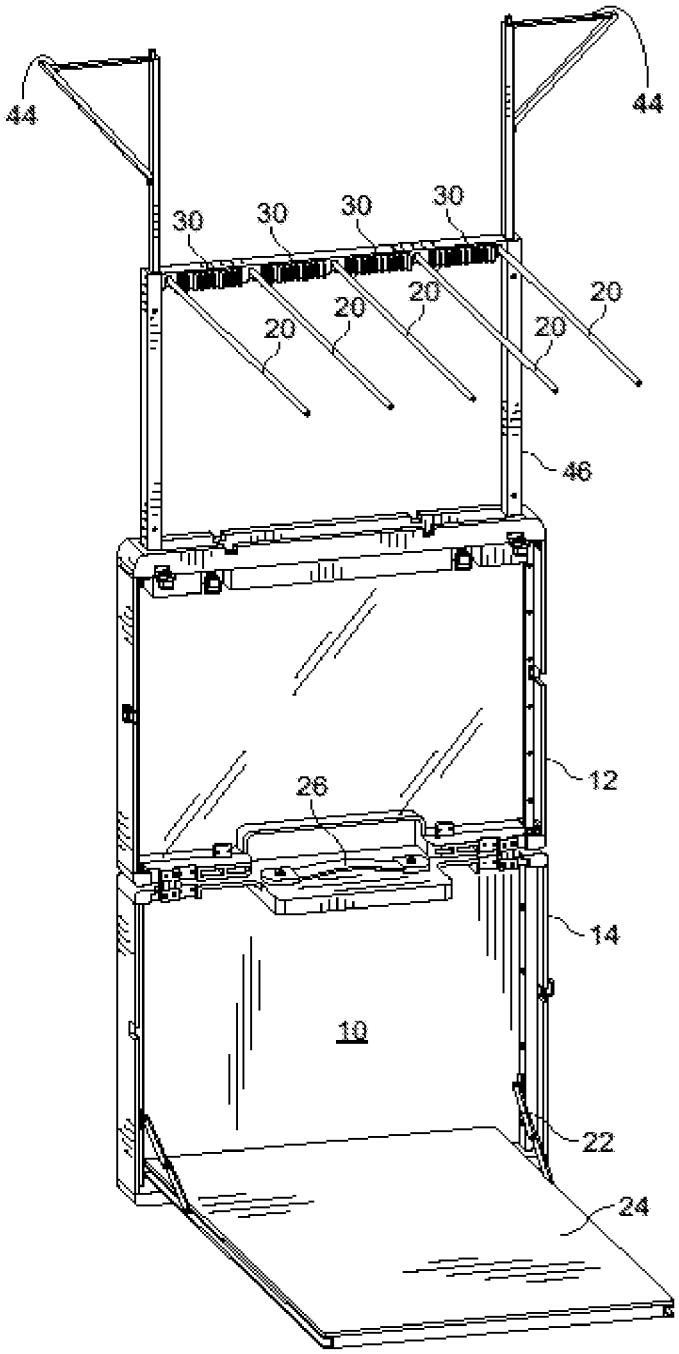
FIG. 9: is a perspective view of a second embodiment of the present invention.

Unless defined otherwise, all terms used herein have the same meaning as are commonly understood by one of skill in the art to which this invention belongs. All patents, patent applications and publications referred to throughout the disclosure herein are incorporated by reference in their entirety. In the event that there is a plurality of definitions for a term herein, those in this section prevail.

The term "collapsible" as used herein refers to a unique construction that allows a device to be reduced in size to make it portable or easily transported.

The term "boardsport" as used herein refers to a variety of sports where a board is used to carry or transport the user from one location to another. Board sports include, for example, snowboarding, surfing, paddle boarding, wake boarding and kite boarding.

The term "locking means" as used herein refers to any method known to those in the art for retaining the position of one element of a device with respect to another element. For example, a locking means may be a locking hinge such as an elbow hinge or a locking lever hinge (see directindustry.com on the worldwide web). Locking means also encompasses a pad lock that may be opened by key or by entering the appropriate code.

The term "flexible" as used herein refers to a material that is easily deformed. In the context of the present invention, a flexible material is one that is deformable but that also provides a barrier to contact to the degree that the element encased or comprising the flexible material reduces or interferes with potential damage resulting from such contact.

The term "stabilizer" as used herein refers to an element that tends to increase the surface area of the base of the device and thereby conferring greater stability from tipping and/or falling over.

The term "polymer" as used herein refers to any polymeric chemical substance used in the manufacture of items including for example, plastics, polyethylene, polypropylene, polystyrene, polyvinyl chloride, polyamides and polycarbonate as well as composite polymers such as carbon fiber and fiberglass.

The present invention provides a collapsible rack for storing boardsport equipment comprising an upper portion and a lower portion connected by at least one lockable hinge. The upper portion having a rotatable top bar having three or more rails extending parallel to each other from the top bar wherein the rails on either end having a locking arm to maintain the rails perpendicular to the upper portion when in use. The lower portion having a rotatable platform base wherein the ends of the rotatable platform base having a locking arm to maintain the base perpendicular to the lower portion when in use. The lower portion or the upper portion may further comprise a handle about the middle of one of its sides and/or a locking mechanism to maintain the rack in a collapsed configuration.

1. Upper Portion

The upper portion 12 of said collapsible rack 10 comprises five sides, four perimeter sides and a base. The four perimeter sides include a top, bottom, left and right sides. The upper portion may be provided in a variety of shapes, preferably a square or rectangle and most preferably a rectangle. The width of the base may range from about 18 to about 24 inches and preferably from about 20 to about 22 inches. The length of the base is preferably from about 24 to about 36 inches and preferably from about 26 to about 30 inches. The thickness of the four perimeter sides are sufficient to encase a rotatable bar 18 affixed on the top side and provide an area for mounting or to provide a lockable hinge 22 on the bottom perimeter side for connecting to the lower portion 14. For example, if the diameter of the rotatable top bar 18 is 1 inch then the thickness of the upper portion perimeter sides would be from about 1.125 to about 3.0 inches, preferably from about 1.25 to about 2.0 inches.

The upper portion 12 may be prepared from a variety of materials including for example, metal, wood, polymer, composite polymers or any combination of these materials. Preferably the material selected is light weight for ease of transport. In one preferred embodiment, the upper portion 12 is prepared by injection molding using high tensile strength durable polymer.

The upper portion 12 may have perimeter sides that when folded in a closed position against the lower portion results in a fully enclosed case. Alternatively, in other embodiments, the perimeter sides may be partially open while still providing sufficient support on the corners of the upper and lower portions to support the rotatable top bar 18, the lockable hinge 22 connecting the two portions and the rotatable platform base 24. This may be achieved in a variety of ways. In one embodiment, perimeter side sections from about 2 to about 4 inches from each corner, around the handle 26 and lockable hinge 16 joining the two portions are removed. Alternatively, these sections may remain but be provided with a number of openings or apertures. In either configuration, the rotatable top bar 18 and the rotatable platform base 24 may be visible and any sand or other material retained in the rack 10 when collapsed may be easily removed through these openings.

The top perimeter side of the upper 12 or lower 14 portion may comprise a handle 26 that enables easy transport of the device. The bottom perimeter side of both the upper 12 and lower 14 portions comprises a lockable hinge 16 that connects the two portions and provides a mechanism that secures the device in the open configuration. The upper 12 and/or lower 14 portions may further comprise at least one connector on either of left and/or right sides, such as a D-loop, for connecting a shoulder strap or harness as an alternative method for transporting the device.

A rotatable top bar 18 having three or more rails 20 is connected to the left and right sides, adjacent and parallel to the top perimeter side and within the upper portion of the device. The bar 18 may be connected to the sides by pins or screws that allow the bar 18 to rotate. A stop is provided that prevents the bar 18 from rotating beyond the point where the rails 20 are perpendicular to the upper portion 12. This rotational stop may be provided in a variety of configurations known to those in the art. In one example, the bar 18 is fixed in position by locking elbow hinges 22, each oriented such that one end is connected to a rail 20 at the end of the bar 18 and the other end connected to the interior perimeter left or right sides of the upper portion 12.

In an alternative configuration, the rotatable top bar does not rotate and each of the three or more rails 20 is connected separately to the upper portion 12, adjacent to and along the top perimeter side. In this configuration, the user may select which rails 20 to activate based on the number of boards to be maintained in the device 10. Each rail 20 may have its own securing mechanism that maintains the rail 20 in a position extending outward from and perpendicular to the upper portion 12. A variety of securing mechanisms known to those in the art may be used. For example, the interior of the top perimeter side may further comprise a clip to receive each of the rails 20 when they are rotated into position for use.

In another configuration, a rotatable top bar with stationary rails or a stationary top bar with rotatable rails is affixed to an extendable rack 46 within the top portion that can be raised to a desired height based on the length of the equipment to be maintained in the device. The extendable rack 46 is slidably affixed to the internal sides of the top portion. Consequently, the height to which the extendable rack 46 may be raised will be dependent on the width of the top portion of the device.

In one preferred configuration, the left and right sides of the upper 12 and lower 14 portions of the collapsible rack 10 may have connectors 36 and 38 that allow the user to connect two or more of the collapsible racks side-to-side or back-to-back forming a larger structure for retaining equipment. A variety of methods may be used to achieve this configuration. In one example, one or more pop-out hooks 36 may be provided on both the upper 12 and lower 14 portions of the collapsible device 10 on one side with corresponding apertures 38 for receiving the pop-out hooks 36 on the other side. In configurations where the sides of the rack 10 are open the connectors 36 and corresponding apertures 38 will be provided closer to the corners of the rack.

One or more lockable hinges 16 will be affixed to or formed within the base perimeter side. If the hinge 16 is incorporated into the base perimeter side, then both portions of the device will have a complimentary half of the locking hinge 16 that may be easily joined during assembly. The locking mechanism of the hinge 16 may be a lever or knob that when cranked or turned in one direction locks the hinge 16 in place and when cranked or rotated in the opposite direction releases the hinge 16 allowing it to rotate easily.

2. Rails

The rails 20 may be prepared from a variety of materials and in a number of configurations. For example, the rails 20 may be prepared from metal, wood or polymer and may be prepared from metal or polymer tubing that is round, square or triangular. One skilled in the art will be able to determine which material and configuration to use based on the boards and equipment to be retained by the device 10. In some uses, the rails 20 may be required to hold the weight of a particular piece of equipment, such as a wetsuit. Consequently, the rail 20 will have to be made of a material and of a thickness that will support the weight of that particular piece of equipment. Those skilled in the art will be able to determine the material and thickness to achieve the desired goal. In a preferred embodiment, the rails 20 are made of a light weight tubular corrosive-resistant metal stock. In one embodiment, the ends of the tubular stock material are capped to prevent water or sand from entering the rails. These caps may be made of a variety of materials and provided in a variety of configurations. Preferably the caps are made of a polymer and may further comprise a hook 40 extending from about the center of the cap. When in place the hooks 40 face upward when the rails 20 are locked into place during use and provide additional areas for storage of equipment, such as fins.

The rails 20 may also be covered with a flexible (i.e., protective) material 30 to prevent damage to the boards to be retained by the device 10 as well as to provide additional protection from corrosion. The protective material 30 may be a polymer plastic, neoprene, foam rubber or similar composition that provides elasticity, flexibility and cushioning capability to protect the equipment from damage. In one configuration, the bar 18 that holds the rails 20 has a flexible material 30 provided on the surface areas between the rails 20 to prevent damage to the sides of the boards retained by the collapsible rack 10.

The rails 20 may be connected to a single bar 18 that is affixed within the upper portion of the device 10 or may be attached rotatably and independently to locations provided in the top side of the upper portion 12 directly.

In another configuration, the rails 20 on the outermost sides of the collapsible device 10 further comprise one or more hooks 40 along the side of the rails for storing additional equipment. In one configuration, collapsible hooks or hangers are telescopically affixed within the supports that form the extendable rack 46. A collapsible hanger 44 may be prepared from a length of stock material having three sections attached by two hinges wherein the first section has desired length (e.g., 12 inches) and the combined length of the second and third sections is approximately that same desired length (i.e., 12 inches). When stored, the second and third sections are folded up against the first section and slid down into or "telescoped" back into the support of the extendable rack 46. When extended, the collapsed hanger 44 is withdrawn from or "telescoped" out of the support of the extendable rack 46 and the third segment is raised upward and fitted into a joint formed in the first segment about ⅓ to ½ along its length. The three segments form a triangular hanger for storing items prior to or after use.

3. Lower Portion

The lower portion 14 of the device 10 will be of similar material, construction and size as that for the upper portion 12 so that when the device 10 is assembled it forms a case.

A rotatable platform base 24 is connected to the left and right perimeter sides, adjacent and parallel to the top perimeter side and within the lower portion of the device 10. The platform base 24 may be connected to the sides by pins or screws that allow the bar to rotate. A stop is provided that prevents the bar from rotating beyond the point where the platform base 24 about perpendicular to the lower portion 14. This rotational stop may be provided in a variety of configurations known to those in the art. In one example, the platform base 24 is fixed in position by locking elbow hinges 22, each oriented such that one end is connected to the side of the platform base 24 and the other end to the interior perimeter left or right sides of the lower portion 14.

The base perimeter side of the lower portion 14 comprises one or more lockable hinges 16 affixed to or formed within the side. If the hinge 16 is incorporated into the base perimeter side the lower portion 14 will have one half of the locking hinge 16 while the upper portion 12 will have the other complimentary half of the locking hinge so that may be easily joined during assembly. The locking mechanism of the hinge 16 may be a lever or knob that when cranked or turned in one direction locks the hinge 16 in place and when cranked or rotated in the opposite direction releases the hinge 16 allowing it to rotate easily.

For additional stability, stabilizer elements 42 are provided, one on each side of the platform base 24 that when utilized rotate 180° and lock into position parallel to the locking hinge 16 that joins the upper 12 and lower 14 portions of the device 10.

In order to maintain structural integrity of the device 10 and assure that it performs effectively, the upper 12 and lower 14 portions have been configured to act as a single unit with the top side of the upper 12 portion comprising the bar 18 and rails 20. A configuration that provides the bar 18 with rails 20 supported by two vertical beams, one on either end of the bar 18, would not be able to prevent the device 10 from collapsing under the forces generated by the weight of a number of boards leaning on one side of the rails 20. Consequently, any device 10 of this construction would not be able to perform all of the functions of the present invention.

4. Lockable Hinge

A variety of lockable hinges 16 may be utilized with the present invention. For example, hinges of this type include locking lever hinges, hinges with locking pins and slide locking hinges.

A locking lever hinge utilizes a lever or knob to tighten the contact between the hinge pin housing to generate sufficient friction to lock the hinge in the desired position. This may be further enhanced by providing interlocking grooves or teeth along the sides of the hinge pin housing.

A locking pin hinge has sides that interface with one another having apertures to accept a pin that locks the hinge in the desired orientation. Alternatively, one interface may have a series of apertures that accept a spring loaded button mounted on the other interface surface. The button automatically enters the aperture when the aperture aligns with the button locking the hinge in place. The hinge may be released by depressing the button with the finger.

A slide locking hinge may be a spring activated hinge with interlocking grooves or teeth along the sides of the hinge pin housing that are disengaged by exerting pressure against the spring. This action allows the hinge to move freely to the location desired and releasing the pressure allowing the grooves or teeth to engage locking the hinge in place.

Any single type or combination of types of locking hinges 16 may be utilized with the present invention.

5. Platform Base

The platform base 24 may be provided as a solid platform having dimensions about the same size as the lower portion 14 and able to fit within the lower portion 14 when rotated into the closed position. Alternatively, the base platform 24 may be provided in a variety of shapes including a "U" or "H" configuration. In the "U" configuration, the platform may be oriented such that the two upper ends of the "U" or the base of the "U" are/is connected to the base side of the lower portion 14. In the "H" configuration, the two upper or lower ends of the "H" are connected to the base side of the lower portion 14 and the bar between the sides of the "H" can have a variety of thicknesses from the same thickness as the sides of the "H" to a thickness about 1 to about 2 inches shorter on each of the sides of the "H". In this configuration, the bar may further comprise a flexible material 30 to safely receive the base of the boards.

Alternatively, the base 24 may be provided as, two separate legs one extending from the left and one extending from the right perimeter sides. In any of these configurations, it is preferable that the platform base 24 have a substantial surface area to provide stability on easily deformable surfaces such as sand. So for example, if the platform base 24 is provided as two separate legs, these legs may have a substantial width or have flared ends to increase the surface area contacting the sand.

The platform base 24 is connected to the lower portion 14 by locking hinges 22. In one example, each legs is fixed in position by locking elbow/arm hinges 22, each oriented such that one end connected to a leg and the other end connected to the interior perimeter sides of the lower portion 14 directly adjacent to the leg.

6. Locking Arm

A locking arm 22 is a hinge that also functions as a bracket to maintain one element at a given angle to a corresponding element. One example of a locking arm hinge 22 is a locking elbow hinge. This hinge generally comprises two elongated and narrow metal strips rotatably connected at one end forming a joint and having a flange extending from one of the sides at the joint such that the sides when opened do not extend beyond 90°. The other ends comprise rotating brackets for mounting the locking arm.

7. Stabilizer

The stabilizer 42 extends the width of the base platform 24 and provides an increased surface area for better stability. This increased stability may be provided in a variety of ways known to those in the art. In one embodiment, two stabilizers 42 are utilized, one rotatably affixed on either side of the base platform 24 and able to extend outwardly from the platform base 24 in opposite directions. Both stabilizers 42 may be secured in a desired orientation utilizing a locking hinge. Preferably the device 10 is set up on a relatively flat surface. However, in circumstances where the surface is not entirely flat, the stabilizers 42 may be secured in orientations that conform to the surface thereby providing greater stability on uneven surfaces.

The material used to prepare the stabilizers 42 will depend on the weight of the boards and sport equipment to be retained by the device 10. Those skilled in the art will be able to determine the type and thickness of the material used to prepare the stabilizers 42 or can test different types and thicknesses of specific materials to determine which has the desired effect. For example, if the device 10 will be holding three paddle boards, a relatively thin high tensile strength material such as metal may be used to prepare the stabilizers 42. Alternatively, a polymer maybe used with a thickness that confers a similar tensile strength as metal. If the device will be holding three skim boards the stabilizers 42 may not require the level of strength as in the previous example and therefore could be prepared from a lower tensile strength metal or polymer that is not as thick.

They may have a length that extends beyond the side of the platform base 24 about 4 to about 24 inches, preferably from about 6 to about 18 inches from the side of the base platform 24. In certain circumstances, the length of the stabilizers 42 are about half the length of the upper 12 and lower 14 portions of the rack 10 and able to fold into the lower portion 14 of the device 10 without contacting each other.

The width of the stabilizers 42 may range from about 2 inches to about the width of the platform base 24. Preferably the width of the stabilizer 42 is from about 4 to about 10 inches.

Alternatively, a stabilizer 42 may be slidably affixed to each side of the base platform 24. A variety of methods known in the art may be used to achieve this configuration. In one embodiment, the stabilizers 42 are provided on guide rails affixed to and flush with the surface of the platform base 24 that contacts the ground. The guide rails may be provided across the entire length of the lower portion 14 or may be provided in two shorter lengths one mounted on each side of the platform base 24 for receiving each stabilizer 42. The guide rails will be position about the middle of the platform base 24. In this configuration, the length of the stabilizer 42 may be about half the length of the platform base 24. This allows each stabilizer 42 to be extended to a desired length independently.

8. Handle

A handle 26 may be a single stationary or rotatable hand grip or a shoulder strap or harness. In a preferred embodiment, a handle 26 and shoulder strap accompany the rack providing the user with multiple methods for comfortably transporting the device 10.

A handle 26 is preferably provided about the middle of the length side as opposed to the width side of the device 10 to prevent contact with the ground during transport. It is also preferable that the handle 26 be provided on the length side that does not comprise the locking hinge 16 connecting the upper 12 and lower 14 portions of the device 10 although either side will work effectively. A variety of handles 16 and handle configurations may be utilized with the present invention.

Shoulder strap connectors may be provided on a variety of locations on the device 10 to allow the user to select the combination with the most comfort. For example, connectors, such as D-loops, may be provided on each side corner of the device 10. In this configuration a strap with clips may be fastened to any combination of corners to allow the user to select which is most comfortable for transporting the device 10. A variety of connectors and corresponding clips are known in the art and may be utilized with the present invention.

9. Securing Means

The securing means 32 for retaining the equipment in the collapsible rack 10 encompasses a restraining strap 32 having an anchor on one end and a locking element on the other. The anchor of a restraining strap 32 may be affixed to a rail 20 or to the upper portion 12 of the collapsible rack 10. The attachment adapter 34 for receiving the locking element may be provided on the adjacent rail. The one or more restraining straps 32 may be a variety of lengths depending on the distance required to encircle the board retained in the collapsible rack 10. Preferably a restraining strap 32 and attachment adapter 34 are affixed near the rail 20 end distant from the bar 18. The locking element 34 may be provided as a turnkey lock or a combination code lock similar to those utilized for bike locks.

10. Locking Mechanism

The locking mechanism 28 is utilized to maintain the collapsible rack 10 in a closed configuration. A variety of methods known in the art may be utilized to accomplish this task. Some locking mechanisms 28 that may be utilized with the present invention include those utilized for brief cases as well as latch clasp toggle latch, hasp latch, a small padlock and other similar mechanisms.

Use

The collapsible rack is a self-contained boardsport rack that may be easily transported to any location for retaining boards and equipment prior to use. The rack may be carried to the appropriate location using the handle or shoulder strap. To set-up the device the user identifies a desired location to store equipment for a given period of time. The user disengages the locking mechanism and opens the device so that the upper and lower portions are parallel. The at least one lockable hinge connecting the upper and lower portions is/are secured by the user so that the two portions remain in a parallel configuration during use. The user may then select whether to engage the rotatable top bar containing the rails or the rotatable platform base. Each is rotated into a position perpendicular to the upper and lower portions and the locking arms engaged to prevent further rotation. The rack is then placed upright in the desired location with the platform base in contact with the ground.

In the second configuration and after the upper and lower portions have been secured parallel to each other, the user may extend the extendable rack, raising the top bar comprising the independently locking rails, to a desired height. One or more of the rails are then raised and locked into place to support the sports boards to be stored in the device. One or both hangers within the supports of the extendable rack may then be raised and secured for holding other items such as a wetsuit prior to or after use.

If the collapsible rack is provided with stabilizers, they may be engaged once the rack is upright by either rotating the stabilizers from the inside of the platform base to the exterior or by pulling the stabilizer outward to a desired length extending them perpendicular to the platform base.

Once upright, boards and other equipment may be placed in the rack. Flexible coatings on the rails and on the bar between the rails prevent potential damage to equipment from contact with the rack. If the rack further comprises restraining straps each board may be secured to the rack by engaging the locking elements of the strap with the attachment adapters on adjacent rails. Other equipment such as wetsuits and fins may be stored on the rack using the hooks available on the end of the rails and on the sides of the two end rails.

In the event that two or more racks are being used they may be connected using the side adapters. In one configuration, the adapters are hooks on the upper and lower portions of the rack on one side with apertures for receiving the hooks on the upper and lower portions of the rack on the other side. To engage the hooks merely insert the hooks of one rack into the apertures of the other rack and apply downward pressure to ensure engagement of the hooks.

The procedures listed above may be reversed when it is desired to move to another location.

What is claimed is:

1. A collapsible rack for storing boardsport equipment comprising: an upper portion and a lower portion connected by at least one lockable hinge, said upper portion having an extension rack having hollow side supports with a rotatable top bar having one rail on each end and one or more rails between said rails on each end said rails extending parallel to each other from said top bar wherein said rails on either end having a locking arm to maintain said rails perpendicular to said upper portion when in use, said hollow side supports having a telescoping collapsible hanger contained within, said extension rack positioned parallel to said upper portion and able to raise said rotatable bar to a desired height above said upper portion, said lower portion having a rotatable platform base to stabilize said collapsible rack when in use wherein said rotatable platform base having a locking arm to maintain said base perpendicular to said lower portion when in use and allows said rotatable platform to rotate parallel to said lower portion when not in use, and wherein said lower portion or said upper portion comprises a handle.

2. The collapsible rack for storing boardsport equipment according to claim 1, further comprising a locking mechanism for maintaining said rack in a collapsed configuration.

3. The collapsible rack for storing boardsport equipment according to claim 1, wherein said rails are encased with a flexible material.

4. The collapsible rack for storing boardsport equipment according to claim 1, further comprising one or more restraining straps each of said restraining straps having two ends, the first end having a locking element and the second end affixed to one of said rails.

5. The collapsible rack for storing boardsport equipment according to claim 4, further comprising one or more attachment adapters on said rails for receiving said locking elements of said one or more restraining straps.

6. The collapsible rack for storing boardsport equipment according to claim 1, wherein said upper and lower portions further comprise one or more connectors and one or more apertures for receiving said connectors that may be used to join two or more collapsible racks during use.

7. The collapsible rack for storing boardsport equipment according to claim 1, wherein at least one of said upper portion and said extension rack further comprise one or more hooks for hanging other boardsport equipment.

8. The collapsible rack for storing boardsport equipment according to claim 1, wherein said top bar further comprises a flexible material between said rails.

9. A collapsible rack for storing boardsport equipment comprising: an upper portion and a lower portion connected by at least one lockable hinge, said upper portion having an extension rack having hollow side supports with a fixed top bar said extension rack being positioned parallel to said upper portion and having one or more rails wherein each of said rails has a locking mechanism to maintain said rail in an extended or collapsed position from said top bar, said hollow side supports having a telescoping collapsible hanger contained within, said extension rack able to raise said fixed bar to a desired height above said upper portion, said lower portion having a rotatable platform base to stabilize said collapsible rack when in use wherein said rotatable platform base having a locking arm to maintain said base perpendicular to said lower portion when in use and allows said rotatable platform to rotate parallel to said lower portion when not in use, and wherein said lower portion or said upper portion comprises a handle.

* * * * *